US010436137B2

(12) United States Patent
Odendall

(10) Patent No.: US 10,436,137 B2
(45) Date of Patent: Oct. 8, 2019

(54) METHOD FOR OPERATING A DRIVE DEVICE AND A CORRESPONDING DRIVE DEVICE

(71) Applicant: AUDI AG, Ingolstadt (DE)

(72) Inventor: Bodo Odendall, Lenting (DE)

(73) Assignee: AUDI AG, Ingolstadt (DE)

( * ) Notice: Subject to any disclaimer, the term of this patent is extended or adjusted under 35 U.S.C. 154(b) by 41 days.

(21) Appl. No.: 15/662,606

(22) Filed: Jul. 28, 2017

(65) Prior Publication Data

US 2018/0112613 A1 Apr. 26, 2018

(30) Foreign Application Priority Data

Oct. 24, 2016 (DE) ..... 10 2016 220 850

(51) Int. Cl.
*F02D 41/14* (2006.01)
*F02D 41/02* (2006.01)
(Continued)

(52) U.S. Cl.
CPC ..... *F02D 41/1441* (2013.01); *F01N 11/007* (2013.01); *F02D 41/0295* (2013.01); *F02D 41/1454* (2013.01); *F02D 41/2474* (2013.01); *F01N 2550/02* (2013.01); *F01N 2560/025* (2013.01); *F01N 2560/14* (2013.01); *F02D 2200/0814* (2013.01)

(58) Field of Classification Search
USPC ..... 60/274, 276, 277, 285, 286, 295; 701/103, 109
See application file for complete search history.

(56) References Cited

U.S. PATENT DOCUMENTS 6,637,195 B2 * 10/2003 Sakai ..... F02D 41/0295 60/285
6,901,744 B2 * 6/2005 Kako ..... F01N 11/007 60/276
(Continued)

FOREIGN PATENT DOCUMENTS

CN 101939520 A 1/2011
CN 104718365 A 6/2015
(Continued)

OTHER PUBLICATIONS

Extended European Search Report dated Mar. 14, 2018, in connection with corresponding EP Application No. 17182770.2 (5 pgs.).
(Continued)

*Primary Examiner* — Binh Q Tran
(74) *Attorney, Agent, or Firm* — Maier & Maier, PLLC

(57) ABSTRACT

A method for operating a drive device with a drive unit and an exhaust gas purification device. The gas exhaust purification device is provided with a catalytic converter through which an exhaust gas stream can flow, as well as with a first lambda sensor arranged upstream of the catalytic converter in the exhaust gas stream and with a second lambda sensor arranged downstream of the catalytic converter in the exhaust gas stream, wherein an oxygen filling value of an oxygen storage device of the catalytic converter is determined on the basis of a first lambda signal provided by the first lambda signal sensor as well as an offset value.

10 Claims, 2 Drawing Sheets

(51) Int. Cl.
*F02D 41/24* (2006.01)
*F01N 11/00* (2006.01)

(56) References Cited

U.S. PATENT DOCUMENTS

| | | | | |
|---|---|---|---|---|
| 9,441,562 | B2 | 9/2016 | Odendall | |
| 10,113,497 | B2 | 10/2018 | Odendall | |
| 2002/0194840 | A1 | 12/2002 | Kako et al. | |
| 2005/0284130 | A1* | 12/2005 | Takubo | F01N 3/10 60/285 |
| 2008/0229727 | A1* | 9/2008 | Wang | F01N 11/00 60/273 |
| 2010/0217506 | A1* | 8/2010 | Mizoguchi | F01N 11/007 701/109 |
| 2013/0103285 | A1 | 4/2013 | Zimmerschied et al. | |
| 2016/0061084 | A1* | 3/2016 | Okazaki | G01N 27/41 60/276 |

FOREIGN PATENT DOCUMENTS

| | | | |
|---|---|---|---|
| CN | 105526020 | A | 4/2016 |
| DE | 10049685 | A1 | 4/2002 |
| DE | 10 2012 019 964 | A1 | 4/2014 |
| DE | 102012019907 | A1 | 4/2014 |
| DE | 10 2013 201 734 | A1 | 8/2014 |
| DE | 102014015523 | B3 | 11/2015 |
| DE | 10 2015 201 400 | A1 | 7/2016 |

OTHER PUBLICATIONS

Examination Report dated Mar. 21, 2017 of corresponding German application No. 102016220850.0; 12 pgs.

Office Action dated Jun. 26, 2019 in corresponding Chinese Application No. 201710800535.0; 12 pages including machine-generated English-language translation.

* cited by examiner

METHOD FOR OPERATING A DRIVE DEVICE AND A CORRESPONDING DRIVE DEVICE

FIELD

The invention relates to a method for operating a drive device with a drive unit and with an exhaust gas purification device, wherein the exhaust gas purification device is provided with a catalytic converter through which an exhaust gas stream of the drive unit can flow, as well as with a first lambda sensor arranged upstream of the catalytic converter in the exhaust stream, and with a second lambda sensor arranged downstream of the catalytic converter in the exhaust gas stream, wherein an oxygen filling value of an oxygen storage device of the catalytic converter as well as an offset value is determined based on a first lambda signal provided by the first lambda sensor, so that when the signal is below a lambda signal lower limit based on a second lambda signal provided by the second lambda sensor and/or above a lambda signal limit provided by the second lambda signal, a calibration step is introduced for calibrating the first lambda sensor, so that when during the calibration step, the oxygen value filling value is below a first value, a value corresponding to an empty oxygen value and/or a second value is set corresponding to a full oxygen storage device when the value is exceeded and the offset value is adjusted based on the second lambda signal. The invention further relates to a drive device.

BACKGROUND

The method is used to operate the drive device or the exhaust gas purification device, which is a component of the drive device. In addition to the exhaust gas purification device, the drive device is equipped with a drive unit, which is provided as a drive unit generating exhaust gas and in this respect generates exhaust gas during its operation.

The drive unit can be provided for example as an internal combustion engine, as a fuel cell or the like. The exhaust gas produced by the drive unit is supplied to the exhaust gas purification device, in particular before the exhaust gas is released into the external environment of the drive device.

The pollutants are removed from the exhaust gas at least partially by means of an exhaust gas purification device. For this purpose, the exhaust gas purification device is provided with at least one catalytic converter through which the exhaust gas of the drive unit can flow in the form of the exhaust stream. The exhaust gas stream device is also associated with two lambda sensors, in particular the first lambda sensor and the second lambda sensor. The first lambda sensor is arranged upstream of the catalytic converter and the second lambda sensor is arranged downstream of the catalytic converter in the exhaust gas stream. At the same time, the two lambda sensor protrude for example into the exhaust gas stream.

The oxygen gas content in the exhaust gas is determined by means of both lambda sensors in the respective positions upstream or downstream of the catalytic converter. The oxygen content can be also determined by means of the first lambda sensors upstream of the catalytic converter, or fluidically between the internal combustion engine and the catalytic converter, and the oxygen content is determined by means of the second lambda sensor downstream of the catalytic converter, in particular fluidically between the catalytic converter and a tailpipe. The first lambda sensor provides a first lambda signal and the second lambda sensor provides a second lambda signal, wherein a first lambda value can be determined from the first lambda signal and a second lambda value can be determined from the latter.

The catalytic converter is provided with an oxygen storage device, or it itself operates as such. This means that in the presence of lean exhaust gas—which is to say in the case when the oxygen excess during the combustions with lambda is greater than one—oxygen passes from the exhaust gas into the oxygen storage device and it is intermediately stored therein. On the other hand, when rich exhaust gas is present—which is the result of combustion with a fuel excess having a lower lambda value than one—the oxygen stored in the oxygen storage device will be removed. In this manner, it is ensured that the stoichiometric ratio, which is necessary for gas purification, can be provided with a lambda value that is equal at least approximately to 1, at least for a certain period of time. The greater the oxygen storage capacity of the catalytic converter, the more oxygen can be temporarily stored in it or in the oxygen storage device, so that a longer period of time can be bridged over with a combustion air ratio that deviates from lambda equals 1.

In particular, the first lambda sensor, which is arranged upstream of the catalytic converter, often has only a low accuracy. For example, if the first lambda signal provided by it deviates by a certain value, the so-called offset error from the actual combustion air ratio in the exhaust gas will occur at the location of the first lambda sensor. As a result of this error, it can happen that the internal combustion engine will be adjusted to a mixture of the composition of the fuel-air mixture that is supplied to the internal combustion engine which deviates from what is required to achieve a good or better conversion performance of the catalytic converter.

Accordingly, the object is to compensate for the error of the first lambda sensor or for the offset error as quickly as possible. This can be done for example by means of a controller which regulates the second lambda signal provided by the second lambda sensor to create a target value. However, this regulation can only be carried out with a very low control speed because control fluctuations occur when a higher speed is used, which in turn leads to a deteriorated conversion performance of the catalytic converter. The regulation of the second lambda signal in order to create a lambda target value is referred to as trimming control. Within the scope of the trimming control, a correction value is determined for the first lambda signal, which is intended to compensate for the offset error. The correction value can in this respect also be referred to as an offset value.

For example, the combustion air ratio is now to be set to a lambda target value, in particular by means of the first lambda signal provided by the first lambda sensor. The lambda target value is preferably determined from a preset lambda value. Conversely, it is of course also possible to determine the first lambda value with the aid of the offset value from the first lambda signal. In other words, the first lambda value is in this case determined from the first lambda signal, so that the first lambda signal is first corrected by means of the offset value. The control variable applied for this control is thus determined from the preset lambda value, from the first lambda value, or from the first lambda value and the offset value. The present lambda value preferably corresponds to lambda equals one.

From prior art is known for example the document DE 10 2012 019 907 A1. It relates to a method for operating an internal combustion engine with an exhaust gas purification device, wherein the gas purification device is provided with a catalytic converter through which an exhaust gas stream of the internal combustion engine can flow, as well as with a lambda sensor arranged upstream of the catalytic converter in the exhaust gas flow, and with a second lambda sensor arranged downstream of the catalytic converter in the exhaust gas flow.

SUMMARY

The object of the invention is to propose a method for operating a drive device which has advantages over known method, in particular because it achieves a high conversion performance of the catalytic converter, wherein an extremely rapid calibration of the first lambda sensor is carried out.

In this case it is provided that after the calibration step, a lambda signal waveform of the second lambda signal is monitored and the calibration step is repeated if an extreme value is detected in the lambda signal waveform.

The oxygen filling rate of the oxygen storage device is determined for example based on a model. In this case it is preferred when integration of an oxygen input into the catalytic converter and/or of an oxygen output from the catalytic converter is carried out from an initial value, wherein the latter can be ignored. Accordingly, the accuracy of the oxygen filling value depends to a great extent on the accuracy of the first lambda signal which describes the oxygen input. Because the first lambda signal, as was already described in the introduction, is often impacted by an offset error, the first lambda signal is corrected with the aid of the offset value, or lambda regulation is carried out on a target value which is determined from the preset lambda value, as well as from the offset value. Therefore, in the control variable of the lambda regulation will be included also the first lambda signal, the preset lambda value and the offset value.

Analogously, in the oxygen filling value is included a variable which is determined from the first lambda signal as well as from the offset value, for example with addition. With the integral determination of the oxygen filling value, the deviation of the first lambda signal from the combustion air ratio that is actually present in the exhaust gas is also integrated so that an error of the oxygen filling state will be increased over time. This is prevented or at least partially decreased with the use of the offset value because—after an appropriately determined period of time—the first lambda signal is corrected in the direction of the combustion air ratio that is actually present.

Correspondingly, however, it is necessary to determine the offset value in order to be able to make a reliable and accurate correction of the first lambda signal. In this determination is used the effect wherein in the case that the first lambda signal has the offset error and, therefore, a mixture composition is adjusted at the drive unit which deviates from the stoichiometric ratio wherein lambda equals one in order to achieve a desired oxygen filling state, the second lambda sensor will show, at least after a certain period of time, either a lack of oxygen or excessive oxygen in the exhaust gas. Therefore, the second lambda signal makes it possible to reach a more accurate conclusion with respect to the filling state of the oxygen storage device of the catalytic converter than with the first lambda signal that is impacted by the offset.

If the second lambda signal is below the lower limit for the lambda signal and/or the if second lambda signal is above the upper lambda signal limit, the calibration step is initiated for calibrating the first lambda sensor. During the course of the calibration step, when the value falls below the limit, the oxygen filling state is first set to the first value, which corresponds to the empty oxygen storage device state. On the other hand, if the second lambda signal exceeds the second lambda signal limit, the oxygen filling value is set to the second value. This value corresponds to a full oxygen storage device. The lambda signal lower limit and the lambda signal upper limit are usually selected differently and they can be for example constant. However, they can be of course also selected as a function of an operating state of the internal combustion engine.

The oxygen filling value of the oxygen storage device is thus reset to a defined value, which has been reliably determined by means of the second lambda signal. If the value is falls below, namely the second lambda signal is below the lower limit for lambda signal. it can be assumed that the oxygen storage device is in fact empty. Accordingly, when the upper limit for lambda signal is exceeded by the second lambda signal, it can be assumed that the oxygen storage device is full. The point in time at which such a reset of the oxygen filling value takes place is intermediately stored, for example in a control device, by means of which the method is carried out.

After the oxygen filling value has been reset, the mixture composition set at the drive unit is adjusted in such a way, in particular controlled and/or regulated, so that—as long as the first lambda value determined from the first lambda signal and from the offset value correspond to the combustion air ratio that is in fact present in the exhaust gas—the preset filling value is set at the oxygen storage device, in particular over a setting time period. The mixture composition should be therefore adjusted in such a way that after the adjustment it will correspond to the preset filling value. It is preferred when the preset filling value is between the first value and the second value, in particular exactly in the middle between both of these values, which means in particular at the oxygen filling value of 50%.

The adjustment is usually carried out on the basis of the first lambda signal, which represents the combustion air ratio present in the exhaust gas upstream of the catalytic converter. However, during the adjustment, the accounting for the oxygen filling value according to the present embodiments assumes that it is started from the oxygen filling value before the adjustment, which is to say either from the first value, or from the second value. It should be pointed out that the oxygen filling value determined in this manner does not necessarily correspond to the oxygen filling state that is actually present in the oxygen storage device.

After the adjustment of the oxygen filling value to the preset filling value, which in particular means when the oxygen filling value corresponds to the preset filling value, the offset value is adjusted on the basis of the second lambda signal. If the oxygen filling value determined from the first lambda signal as well as the offset value correspond essentially to the combustion air ratio that is present in the exhaust gas upstream of the catalytic converter, then the actual oxygen filling state that is present after installation corresponds to the preset filling value. This means that a certain amount of the oxygen is stored in the oxygen storage device.

Accordingly, the second lambda signal, which is substantially independent of the first lambda signal, indicates a stoichiometric ratio in the exhaust gas downstream of the catalytic converter. When this is the case, then no correction of the offset value is necessary and at the most an adaptation of the offset value will take place during which the latter is not changed or only slightly changed.

On the other hand, if the second lambda signal indicates an oxygen deficiency or an excess of oxygen, although the calculated oxygen filling value corresponds to the preset filling value, the oxygen storage device is in fact either completely filled or completely emptied. Accordingly, it can be concluded that the combination of the first lambda signal and the offset value does represent the combustion air ratio that is in fact present in the exhaust gas. The offset value is therefore corrected, which depends on whether the second lambda signal corresponds to an excess of oxygen or to an oxygen deficiency. The adjustment is preferably carried out only if the second lambda signal falls below a certain lower limit value, or if it exceeds a certain upper limit value, in particular if it falls further below or if it further exceeds this value.

After the adjustment of the offset value, the calibration step is finished. After the calibration step, the second lambda signal or its course is monitored in the form of the progress of the lambda signal. If an extreme value is detected in the course of the lambda signal, which is to say a maximum or a minimum, the calibration step is repeated, in particular repeated immediately. In other words, the calibration step is carried out again as soon as it is determined that the adjustment of the offset value was not sufficient. This results from a "tilting" of the second lambda signal in the direction of its initial value that was in particular present prior to the initiation of the calibration step.

The lambda signal displays during the initiation of the calibration step the determined value. Since the oxygen filling value is adjusted to the preset filling value, in particular through a corresponding adjustment of the mixture composition to the drive unit, a difference between the second lambda signal and the value is next increased.

If the adjustment of the offset value was sufficient, the second lambda signal is increased starting from the initial value in the direction of the target value and after that it remains approximately on this value. If the adjustment was not sufficient, the difference between the second lambda signal and the initial value becomes at first larger and it will then subsequently decrease again. According, the second lambda signal "tilts" back again in the direction of the initial value, which occurs after the extreme value has been exceeded.

As soon as such an extreme value is ascertained, it is determined that the matching of the offset value was not sufficient. Accordingly, the calibration step is repeated again to adjust again the offset value. This takes place until the extreme value no longer occurs after the calibration step and the second lambda signal instead remains on its target value.

Within the scope of another embodiment of the invention it is provided that in order to monitor the second lambda signal, a maximum value and/or a minimum value of the second lambda signal are/is determined, wherein the extreme is determined when the value is below the maximum value and/or above the minimum value. After the calibration step, the maximum value and/or the minimum value of the second lambda signal are permanently detected. For example, at the end of the calibration step, for example immediately after adjusting the offset value or when the adjusted offset value of the maximum value and/or of the minimum value is reset, preferably by setting a very small minimum value and a very large initial value.

If subsequently the second lambda signal exceeds the maximum value, the maximum value is set to equal the second lambda signal. Similarly, when the second lambda signal is below the minimum value, the minimum value is set to equal the second lambda value. If the second lambda signal now falls below the maximum value and/or exceeds the minimum value, the presence of an extreme value is detected and accordingly, the calibration step is repeated.

According to a further development of the invention, the extreme value is only detected when the minimum value is exceeded by a minimum amount, or the value has fallen below the maximum value by the minimum amount. Very small fluctuations around the maximum value or minimum value, respectively, are not intended to trigger a new performance of the calibration step. Instead, this should occur only when the second lambda signal deviates by the minimum amount from the maximum value or from the minimum value. The minimum value is for example constant, in particular absolute and relative with respect to the second lambda value and/or the extreme value.

Within the scope of another embodiment of the invention, the minimum amount is determined as a function of the second lambda value and/or of the extreme value. For example, the minimum value is the initial value with a function which has as the initial value the second lambda value or the second lambda signal and/or the extreme value.

In an advantageous embodiment of the invention, in order to adjust the offset value, the offset value is incremented by a differential value when after the adjustment of the preset filling value the second lambda signal corresponds to a lean mixture composition, and/or it is decremented by the differential value when after the adjustment to the preset filling value, the second lambda signal corresponds to a rich mixture composition. If an air excess is thus determined by means of the second lambda sensor, the offset value is increased by the differential value. On the other hand, if the presence of an oxygen deficiency is determined downstream of the catalytic converter, the offset value is decreased by the differential value. The differential value can in this case be constant or it can be determined as variable depending on an operating variable and/or on a state variable of the drive device, in particular of the drive unit.

In a further development of the invention it is provided that the differential value is constant or it is determined as a function of a lambda differential value, which corresponds to the difference between the oxygen filling value and an assumed value determined based on the second lambda signal, wherein when the assumed value falls below the lambda signal lower limit, it is set by means of the second lambda signal to the first value and/or when the upper lambda signal limit is exceeded, it is set by means of the second lambda signal to the second value. The differential value, by means of which the offset value is adjusted, can be also selected as constant. For example, depending on the sign of the second lambda signal, it is added after setting the oxygen filling value to the preset filling value to the offset value that was valid up until that point and then deducted from this value. However, when the differential value is constant, there is no adaptation and the combustion air ratio that is in fact present will depend on the difference between the difference determined from the first lambda signal and the offset value. Therefore, the difference is preferably determined in a variable manner as a function of at least one variable.

Such a variable is for example the lambda differential value. Additionally or alternatively, the difference depends on the gradient of the second lambda signal. When the combustion air ratio that is present in the exhaust gas upstream of the catalytic converter is still far from a stoichiometric ratio, a large gradient of the second lambda signal follows from the setting of the oxygen filling value to the preset filling value. This can be attributed to the fact that the oxygen storage device has a small effect which in any case differs from the stoichiometric ratio region.

When the combustion air ratio is already in the vicinity of the stoichiometric ratio, then lambda is already approximately equal to one, which means that the effect of the oxygen storage device is clearly greater. The second lambda signal thus reacts with a smaller gradient to the change of the mixture composition, which is selected during the adjustment of oxygen filling value to the preset filling value. For example, a maximum of the gradient is applied during the setting of the maximum value of the gradient to determine the difference value. As an alternative, it is of course also possible to use a temporal mean value of the gradient for the setting.

For example, it can be provided that the differential value is determined by means of a controller which is provided at least with a proportional element, with an integral element and/or with a differential element. This type of determination of the differential value is used in particular when the differential value is variable, which is to say that it is dependent for example on the lambda differential value and/or on the gradient of the second lambda signal.

The lambda differential value is determined for example from the oxygen filling value and from the assumed value. The assumed value is in this case determined by using the second lambda signal. If the second lambda signal is after the adjustment of the oxygen filling value to the preset filling value smaller than the lower limit for the lambda signal, the second lambda signal is set to the first value. Similarly to this, it can be provided that the assumed value is set to the second value when after the adjustment, the second lambda signal exceeds the upper limit for the lambda signal.

It has been already explained above that a conclusion can be reached on the basis of the second lambda signal as to whether the oxygen storage device is filled or emptied. An extremely precise conclusion can be reached by means of the second lambda sensor as to whether the value is below the lower lambda signal limit with respect to the oxygen filling state of the oxygen storage device. On the other hand, the oxygen filling value indicates the assumed oxygen filling state. The required extent of the adjustment of the offset value can be therefore derived with a higher precision from the difference between the oxygen filling value and the assumed value.

In addition to the difference between the oxygen filling value and the assumed value, it is also possible to use an exhaust gas mass flow and/or the duration of the adjustment time period during which the adjustment of the oxygen filling value to the preset filling value takes place. The exhaust gas mass flow describes the amount of the exhaust gas per unit of time, in particular the mass of the flow that passes per unit of time through the catalytic converter. The mass of the oxygen that is at least theoretically stored in the oxygen storage device can be obtained from the following formula:

$$m_{O2} = \left(\frac{\lambda_{ein} - 1}{\lambda_{ein}} - \frac{\lambda_{aus} - 1}{\lambda_{aus}}\right) \cdot \dot{m} \cdot \Delta t$$

[$ein$ = in, $aus$ = out]

wherein $\lambda_{in}$ corresponds to the first lambda value, $\lambda_{out}$ corresponds to the second lambda value, $\dot{m}$ corresponds to the exhaust gas mass stream and $\Delta t$ corresponds to the duration of the adjustment time period.

However, the size of the $\lambda_{out}$ or of the second term can be often ignored because the combustion air ratio in the exhaust gas that is flowing out of the catalytic converter equals one due to the oxygen storage device. Accordingly, the formula can be simplified as follows:

$$m_{O2} = \left(\frac{\lambda_{ein} - 1}{\lambda_{ein}}\right) \cdot \dot{m} \cdot \Delta t$$

The lambda differential value $\Delta t$ can be determined for example from the formula $$\Delta\lambda = 1 + \frac{\Delta m_{O2}}{\dot{m} \cdot \Delta t}$$

wherein the variables used correspond to those defined above. The specific relationship applies to $\lambda$=1. As a basis for the determination is used the oxygen mass difference $\Delta m_{O2}$, which on the one hand expresses the difference between the combination of the first lambda signal, and on the other hand the offset value and the combustion gas ratio that is actually present in the exhaust gas. In other words, the oxygen mass difference corresponds to the difference between the oxygen filling value and the assumed value or vice versa.

Within the context of another preferred embodiment of the invention, the adjustment of the oxygen filling value to the preset filling value is carried out in an adjustment time period, wherein the duration of the adjustment time period is constant, or it is selected depending at least on one operating variable of the drive device, in particular on the first lambda signal and/or on the second lambda signal. The adjustment takes place in this respect over the adjustment time period, which is to say it begins at the beginning of the adjustment time and ends at the end of the adjustment time period. The duration of the adjustment time period is always greater than zero and it corresponds—when it is selected as constant—for example to at least 1 second, at least 2 seconds, at least 3 seconds, at least 4 seconds or at least 5 seconds. Alternatively, a variable duration can be also selected, for example as a function of the operating variable. As such is preferably used at least one of both lambda signals, in particular the second lambda signal of the second lambda sensor which is arranged downstream of the catalytic converter.

For example, an initial value is noted at the beginning of the adjusting period, wherein the initial value is thus set to be equal to the lambda signal present at this time. During the adjusting time period, a different value of the current lambda signal from the output value is determined continuously or in intervals. The maximum value of the differential value is held during the adjustment time period in the form of a maximum differential value—namely depending on whether an oxygen filling value is set to the first or to the second value—as a minimum value or as a maximum value of the lambda signal.

If the lambda signal corrected with the offset value does not correspond to the actual combustion air ratio, the lambda signal is changed after the maximum difference has been exceeded again in the direction of the initial value. If the (momentary) differential value is below the maximum differential value, or if it exceeds a threshold value for a difference between the (momentary) differential value and the maximum differential value which is different from zero, the adjustment time period is ended and the offset value is adjusted. Since a conclusion can be reached based on the progress of the differential value that the offset error has not been fully compensated for by means of the offset value, it is preferred when the process is immediately repeated, which is to say when the calibration step is carried out again.

According to a preferred embodiment of the invention, the first lambda sensor is used as a wide band lambda and/or as a second lambda sensor is used a leap lambda sensor. The leap lambda sensor has in comparison to the wide band lambda sensor only a relatively small lambda window within which the lambda signal is changed. For example, the lambda window of the leap lambda sensor is in a range from 0.89 to 1.02, within which the lambda signal supplied by the lambda sensor is changed. In contrast to the, the lambda signal remains constant outside of this lambda window.

By means of the wide band lambda sensor, a lambda window can be covered that is several times greater than the lambda window of the lambda sensor with the leap lambda sensor. For example, the lambda window of the wide band lambda sensor is in a range that is limited by a lower limit and by an upper limit, wherein the lower limit is for example 0.8 to 0.9 and the upper limit is up to 3, up to 2, up to 1.2 or up to 1.1. Both lambda sensors can be of course also designed either as wide band lambda sensors or as leap lambda sensors. It is particularly preferred, however, when the first lambda sensor is designed as a wide band lambda sensor and the second lambda sensor is designed as a leap lambda sensor.

It can be further provided that the oxygen filling value is determined by means of a model, in particular integrally, from the first lambda signal. Such a method has been already mentioned. It is therefore preferred when the oxygen filling value is determined solely on the basis of the first lambda signal so that the second lambda signal is not taken into consideration at all. This is sufficient to allow for an accounting for the oxygen input into the oxygen storage device and for the oxygen output from the oxygen storage device, in particular because due to the oxygen storage device, the combustion air ratio present downstream of the catalytic converter equals one.

However, it can be also provided that in addition to the first lambda signal, the second lambda signal is also taken into account for the determination of the oxygen filling value. In this manner, the accuracy can be increased again because the amount of the oxygen leaving the catalytic converter can be determined with a higher precision. If the second lambda sensor is designed as a leap lambda sensor, it is possible to use for this purpose for example linearization of the second lambda signal. The determination of the oxygen filling value is carried out preferably integrally, which is to say based on a fixed value, for example the first value or the second value, which is used to reset the oxygen filling value under the conditions mentioned above.

Finally, it may be provided in a preferred embodiment of the invention that the preset filling value is set to a value that is between the first value and the second value. It is at least provided that preset filling value deviates both from the first value and from the second value. This deviation is preferably as large as possible to make it possible to set the distance to be bridged over with the adjustment of the oxygen filling value to be as large as possible. Accordingly, the preset filling value is preferably set between the first and the second value, for example to 50% of the difference between both values starting from one of the two values.

The invention further also relates to a drive device, in particular to a drive device for carrying out the method described above which is provided with a drive unit and with an exhaust gas purification device, wherein the exhaust gas stream purification device is equipped with catalytic converter through which the exhaust gas can flow as well as with a first lambda sensor arranged in the exhaust gas stream upstream of the drive unit and a second lambda sensor arranged in the gas exhaust downstream of the catalytic converter.

The drive device is designed to determine an oxygen filling value of an oxygen storage device of the catalytic converter on the basis of a first lambda signal provided by a first lambda sensor, as well as an offset value, so that when a value falls below a lambda signal lower limit with a second lambda signal provided by a second lambda sensor and/or when an upper lambda signal limit is exceeded by the second lambda signal, a calibration step is initiated for calibrating the first lambda sensor, wherein during the calibration step, the oxygen filling value is set when it is below the lower level to a first value corresponding to an empty oxygen storage device, and/or when it is exceeded, it is set to a second value corresponding to a full oxygen storage device, which adjusts the oxygen filling value to a preset filling value and the offset value is adjusted based on the second lambda signal.

At the same time, the drive device is further configured to monitor after the calibration step the course of the lambda signal with the second lambda signal, so that when an extreme value is determined during the course of the lambda signal, the calibration step is repeated.

The advantages of such a configuration of the drive device or of such a method have already been mentioned. Both the driving device and the method for carrying it out can be further developed according to the explanations above, so that reference is made to them in this respect.

BRIEF DESCRIPTION OF THE DRAWINGS

The invention will be next explained in more detail based on embodiments illustrated in the attached figures, without limiting the invention. The figures show the following.

DETAILED DESCRIPTION

Figure 1:
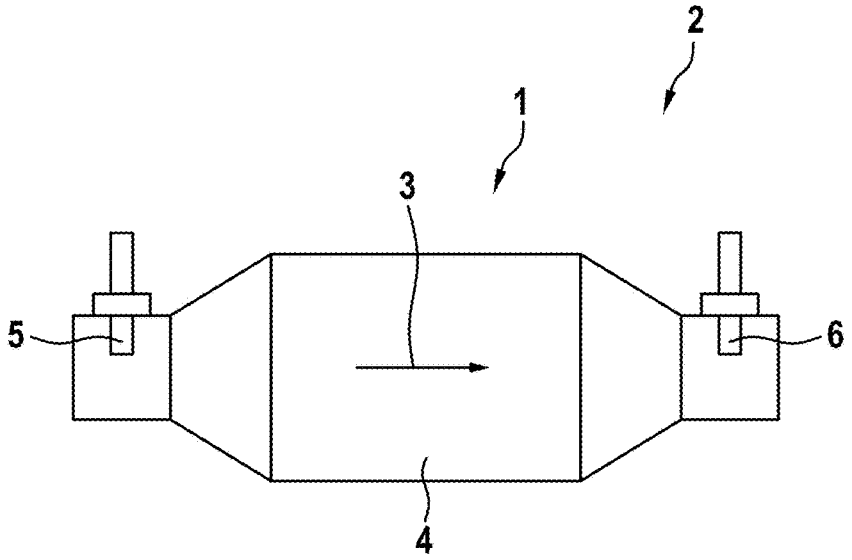
FIG. 1 is a schematic illustration of a region of an exhaust gas purification device provided with a gas exhaust purification device having a catalytic converter, as well as with a first lambda sensor and with a second lambda sensor.

FIG. 1 shows a region of an exhaust gas stream purification device 1, which is provided as a component of a drive device 2. An exhaust gas stream passes through the exhaust gas purification device 1 in the direction of the exhaust gas stream of the drive device 2 that is shown by arrow 3. The exhaust gas purification device 1 is provided with a catalytic converter 4 which is equipped with an oxygen storage device or with the capability for storing oxygen. A first lambda sensor 5 is located upstream of the catalytic converter 4, while a second lambda sensor 6 is located downstream of the catalytic converter. The exhaust gas received from the drive unit next flows first through the first lambda sensor 5, then it flows through the catalytic converter 4 and finally it flows through the second lambda sensor 6. The residual oxygen content in the exhaust gas is determined by means of the first lambda sensor 5 and after the catalytic converter 4 it is determined by means of the second lambda sensor 6. The residual oxygen content can be indicated in the form of a combustion air ratio.

Next, an oxygen filling value of the oxygen storage device of the catalytic converter 4 is to be determined on the basis of the first lambda signal provided by the first lambda sensor 5. In addition, an offset value Δλ is also taken into account, by means of which an offset error is completely compensated for. The second lambda signal provided by the second lambda sensor 6 is applied in particular on order to determine the offset value Δλ. If this value is below a lower limit for the lambda signal, an oxygen filling value is set to a first value that corresponds to an empty oxygen storage device. On the other hand, if the second lambda signal exceeds an upper limit for the lambda signal, the value is set to a second value indicating a full oxygen storage device. This occurs in the context of a calibration step which is carried out in order to calibrate the first lambda sensor 5.

Subsequently, in particular directly following the resetting of the oxygen filling value, the drive unit is operated in such a way that the oxygen filling value determined on the basis of the first lambda signal is adjusted or regulated over an adjustment time period to a preset filling value. At the latest by the end of the adjustment time period, the oxygen filling value determined with computation should therefore coincide with the preset filling value. However, this does not mean that the oxygen filling state that is in fact present is also equal to the preset filling value. If at the end of the adjustment time period the second lambda signal still deviates from a stoichiometric relationship, it will be concluded from this that the combination of the first lambda signal and of the offset value Δλ does not in fact represent the combustion air ratio that is in fact present in the exhaust gas. Accordingly, the offset value Δλ will be adjusted on the basis of the second lambda signal.

After the calibration step has been carried out, in particular after the adjustment of the offset value on the basis of the second lambda signal, the course of the second lambda signal is monitored. If an extreme value is determined in the course of the lambda signal, the calibration step is repeated. In particular, the calibration step is repeated until the second lambda signal has reached a desired value, for example a value corresponding to a stoichiometric combustion air ratio, or at least until it is in a certain range in the vicinity of this value, which is to say that it for example neither falls below the lower limit for the lambda signal, nor does it exceed the upper limit for the lambda signal. Both the lower limit for the lambda signal and the upper limit for the lambda signal are different from a stoichiometric ratio, wherein the lambda signal lower limit is for example less than a combustion air ratio of one and the lambda signal upper limit corresponds to a combustion air ratio of more than one.

Figure 2:
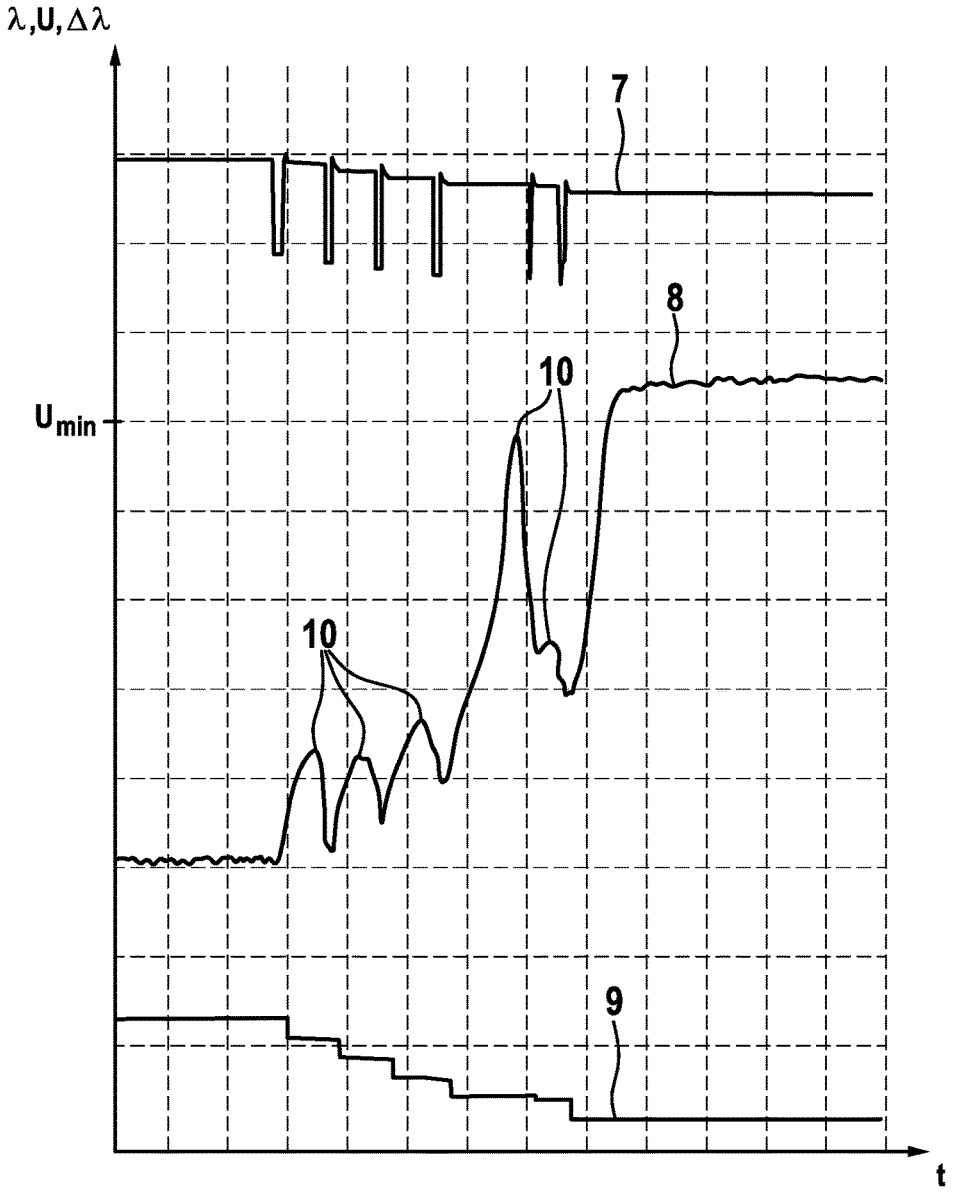
FIG. 2 is a diagram showing the progress of a lambda signal supplied by a first lambda sensor, wherein the progress of the second lambda sensor provided by the second lambda sensor and of an offset value is plotted over time.

FIG. 2 shows a diagram in which three waveforms, 7, 8 and 9 are plotted over time t. The progress of waveform 7 corresponds to the first lambda signal which is present in the form of a combustion air ratio. The progress of waveform 8 describes the second lambda signal which is indicated as an electric voltage. Finally, the progress of waveform 9 indicates the offset value Δλ. It should be noted that the time scale illustrated here as well as the other variables are indicated purely by way of an example and that they only serve to illustrate the method according to the invention.

For the second lambda signal is defined a lower lambda signal limit in the form of voltage $U_{min}$, wherein for example, $U_{min}$=650 mV. If the second lambda signal as shown here is below the lower lambda signal limit, a calibrating state will be initiated. As one can see based on the progress of the waveform 7, in this case, the first the mixture composition of a fuel-air mixture supplied to a drive unit is adjusted in such a way that the oxygen is discharged from the oxygen storage device. This takes place in such a way that the oxygen filling value is adjusted to a preset filling value. After that, the offset value is adjusted based on the second lambda signal, wherein the offset value is reduced in the embodiment illustrated here.

Due to the oxygen output from the oxygen storage device, the second lambda value will start changing starting from an initial value, in particular in the direction of a stoichiometric combustion air ratio. After the calibration step, the progress of the waveform 8 of the second lambda signal is monitored. If an extreme value 10 is determined in this manner (several such extreme values 10 are indicated in the embodiment illustrated here), the calibration step is repeated for further calibration of the first lambda sensor. The occurrence of the extreme value indicates that the adjustment of the offset value was not sufficient because the second lambda signal is again "tilted" in the direction of its initial value. Accordingly, further measures are taken.

With the method described here, an error of the first lambda sensor 5 can be determined quickly, with precision and without the risk of controller fluctuations. The drive device 2 thus adjusts itself to the offset error of the first lambda sensor 5 and it can be subsequently operated in such a way that the exhaust gas produced by it corresponds to a stoichiometric combustion air ratio so that it can be at least for the most part maintained free of pollutants by means of the catalytic 4.

The invention claimed is:

1. A method for operating a drive device with a drive unit and an exhaust purification device, wherein the exhaust purification device is provided with a catalytic converter, a first lambda sensor arranged upstream of the catalytic converter, and a second lambda sensor arranged downstream of the catalytic converter, the method comprising:

determining an oxygen filling value of an oxygen storage device of the catalytic converter on the basis of a lambda signal provided by the first lambda sensor as well as an offset value;

initiating a calibration of the first lambda sensor when a second lambda signal provided by the second lambda sensor falls below a lower lambda signal limit or when the second lambda signal exceeds a lambda signal upper limit;

during the calibration step, setting the oxygen filling value to a first value corresponding to an empty storage device when the second lambda signal falls below the lower lambda signal limit, setting the oxygen filling value to a second value corresponding to a full oxygen storage device when the second lambda signal exceeds the upper lambda signal limit, and immediately after setting the oxygen filing value, adjusting the oxygen filling value over an adjustment time period to a preset filling value and adjusting the offset value on the basis of the second lambda signal; and after the calibration step, monitoring progress of the second lambda signal and repeating the calibration step when an extreme value is detected in the progress of the second lambda signal.

2. The method according to claim 1, further comprising:

setting a maximum value of the second lambda signal and a minimum value of the second lambda signal, wherein the extreme value is a value that falls outside a range of values from the minimum value to the maximum value.

3. The method according to claim 2, wherein the extreme value is detected only when the extreme value deviates above the maximum value by a minimum amount, or when the extreme value deviates below the minimum value by the minimum amount.

4. The method according to claim 3, wherein the minimum amount is determined as a function of the second lambda signal and of the extreme value.

5. The method according to claim 1, wherein adjusting the offset value further comprises:

incrementing the offset value with a differential value when, after the adjustment to the preset filling value, the second lambda signal corresponds to a lean mixture composition, and decrementing the offset value with a differential value when, after the adjustment to the preset filling value, the second lambda signal corresponds to a rich mixture.

6. The method according to claim 5, wherein the differential value is constant, or is determined as a function of a lambda differential value, the lambda differential value corresponding to the difference between the oxygen filling value and an assumed value determined on the basis of the second lambda signal, wherein when the assumed value falls below the lower lambda signal limit, the assumed value is set by the second lambda signal to the first value, and when the assumed value exceeds the upper lambda signal limit, the assumed value is set by the second lambda signal to the second value.

7. The method according to claim 1, wherein a duration of the adjustment time period is selected as a function of at least one operating variable of the drive device.

8. The method according to claim 1, wherein the oxygen filling value is determined by means of a model.

9. The method according to claim 1, wherein the preset filling value is set to a value that is between the first value and the second value.

10. A drive device, comprising:

a drive unit with an exhaust gas purification device, wherein the gas purification device is provided with a catalytic converter, a first lambda sensor arranged upstream of the catalytic converter in and exhaust gas stream, and a second lambda sensor arranged downstream of the catalytic converter in the exhaust gas stream, the drive device configured to:

determine an oxygen filling value of an oxygen storage device of the catalytic converter on the basis of a lambda signal provided by the first lambda sensor as well as an offset value, initiate a calibration of the first lambda sensor when the second lambda signal falls below a lower lambda signal limit or when the second lambda signal exceeds an upper lambda signal limit, wherein during the calibration step, when the second lambda signal falls below the lower lambda signal limit, a first value is set corresponding to an empty oxygen storage device and when the second lambda signal exceeds the upper lambda signal limit, a second value is set corresponding to a full oxygen storage device, the oxygen filling value is adjusted over an adjustment time period to a preset filling value and the offset value is adjusted on the basis of the second lambda signal, wherein the drive device is further configured to monitor after the calibration step lambda signal progress of the second lambda signal and to repeat the calibration step when an extreme value is determined in the lambda signal progress.

* * * * *